US008102231B2

(12) United States Patent
Van Nimmen et al.

(10) Patent No.: US 8,102,231 B2
(45) Date of Patent: Jan. 24, 2012

(54) END CAP FOR AN INDUCTIVE COMPONENT AND INDUCTIVE COMPONENT

(75) Inventors: Steven Van Nimmen, Ghent (BE); Michael Siotto, Deinze (BE); Tom Ocket, Torhout (BE); Jan Van Cauwenberge, Aalter (BE)

(73) Assignee: Tyco Electronics Belgium EC N.V., Oostkamp (BE)

( * ) Notice: Subject to any disclaimer, the term of this patent is extended or adjusted under 35 U.S.C. 154(b) by 832 days.

(21) Appl. No.: 11/873,172

(22) Filed: Oct. 16, 2007

(65) Prior Publication Data

US 2008/0088402 A1 Apr. 17, 2008

(30) Foreign Application Priority Data

Oct. 17, 2006 (DE) ..... 10 2006 049 485

(51) Int. Cl.
*H01F 27/30* (2006.01)

(52) U.S. Cl. ..... 336/198

(58) Field of Classification Search ..... 336/65, 336/90, 192, 196, 198, 206–208; 343/787–788, 343/702, 895
See application file for complete search history.

(56) References Cited

U.S. PATENT DOCUMENTS

| | | | | |
|---|---|---|---|---|
| 4,725,845 | A * | 2/1988 | Phillips | 343/702 |
| 5,531,390 | A | 7/1996 | Gustafson | |
| 5,600,494 | A | 2/1997 | Kubo et al. | |
| 5,606,488 | A | 2/1997 | Gustafson | |
| 5,649,352 | A | 7/1997 | Gustafson | |
| 5,995,064 | A * | 11/1999 | Yanagisawa et al. | 343/895 |
| 6,097,340 | A * | 8/2000 | Chang | 343/702 |
| 6,111,554 | A * | 8/2000 | Chufarovsky et al. | 343/895 |
| 6,922,178 | B2 * | 7/2005 | Sutter et al. | 343/895 |
| 2002/0079999 | A1 | 6/2002 | Abdel-Tawab et al. | |
| 2003/0071755 | A1 * | 4/2003 | Lin et al. | 343/702 |
| 2003/0128092 | A1 | 7/2003 | Maguire et al. | |
| 2003/0137818 | A1 | 7/2003 | Chou | |
| 2007/0091009 | A1 | 4/2007 | Lueg-Althoff et al. | |

FOREIGN PATENT DOCUMENTS

| | | | |
|---|---|---|---|
| DE | 3337416 | A1 | 4/1985 |
| DE | 4205742 | A1 | 9/1992 |
| DE | 19812836 | A1 | 9/1999 |
| DE | 20209817 | U1 | 11/2002 |
| WO | 2005045992 | A2 | 5/2005 |
| WO | 2005/062316 | A2 | 7/2005 |

OTHER PUBLICATIONS

European Search Report cited in co-pending EP Application No. 07019641.5, dated Feb. 14, 2011, 6 pages.

* cited by examiner

*Primary Examiner* — Tuyen Nguyen

(74) *Attorney, Agent, or Firm* — Barley Snyder LLC

(57) ABSTRACT

An end cap for an inductive component is disclosed. The end cap has a receptacle configured to receive the inductive component along a longitudinal direction, a jaw extending in the longitudinal direction, and a guide device disposed on the jaw and configured to allow turning of a wire thereon.

20 Claims, 2 Drawing Sheets

END CAP FOR AN INDUCTIVE COMPONENT AND INDUCTIVE COMPONENT

CROSS-REFERENCE TO RELATED APPLICATION DATA

This application claims the benefit of the earlier filed parent patent application document DE 10 2006 049 485.7 having a filing date of Oct. 17, 2006.

FIELD OF THE INVENTION

The invention relates to an end cap for an inductive component, such as a core with wire wound around it.

BACKGROUND

It is known for a core made of ferromagnetic material and serving as an antenna rod to be inserted in a housing and for the wire then to be wound around the housing. The disadvantage of this solution is that the wire and core are separated from one another by the interposed housing, which, owing to scatter losses, leads to reduced efficiency. In addition, different core shapes require the use of differently shaped housings.

It is also known for the wire to be fixed with adhesive tape or similar, and for the core with wire wound around it then to be secured in a housing. The disadvantage here is that the automatic application of the adhesive tape can be achieved only with great complexity, which involves high unit costs, especially in the case of mass production.

DE 198 128 36 A1 shows an inductive miniature component for SMD assembly, with a one-part massive core made of poorly electrically conductive material, in particular ferrite material, and with at least one coil winding disposed around the core. On at least one of its ends, the core has a coil-free section, which may take the form of a rectangular flange and on which a coupling plug made of the same material is integrally formed. Wound onto the coupling plug multiple times is one end of the winding. In the region of the coupling plug, the underside of the coil windings is provided with a tinning coat.

WO 2005/062316 A2 and WO 2005/045992 A2 relate to directionally-independent, flat antennas of miniature design.

Since the direct application of windings to ferrite material is regarded as difficult from the manufacturing viewpoint, a flat winding body in plastic is provided in WO 2005/062316 A2 for an inductive miniature component with three coil windings located perpendicularly to one another. A flat ferrite core in inserted into the winding body.

WO 2005/045992 A2 also relates to an inductive miniature component equipped with three coil windings located perpendicularly to one another. The coil windings are applied to a flat winding body, which is made at least in part of ferrite material and which is provided on its top face and bottom face with guiding elements for directing the third coil winding. Further provided is a coil plate with corners or projections around which the ends of the third coil winding are wound.

The devices from WO 2005/045992 and WO 2005/062316 are specially matched to the geometry of antennas with three coil windings located perpendicularly to one another and of flat design. For rod-shaped cores, for example, the solutions described in these two documents are unsuitable, which severely restricts their application range.

SUMMARY

An end cap for an inductive component is disclosed. The end cap has a receptacle configured to receive the inductive component along a longitudinal direction, a jaw extending in the longitudinal direction, and a guide device disposed on the jaw and configured to allow turning of a wire thereon.

An object of the invention, among others, is to create a device for cores with wire windings, which device can be used irrespective of the length of the core, is simple to install and highly efficient owing to reduced scatter losses.

BRIEF DESCRIPTION OF THE DRAWINGS

The invention will be described hereinafter in greater detail using an embodiment and with reference to the drawings. Some features of the embodiment may be omitted according to the aforementioned advantages if the advantage connected to the feature is not necessary for a certain application. In the drawings.

DETAILED DESCRIPTION OF THE EMBODIMENT(S)

Figure 1:
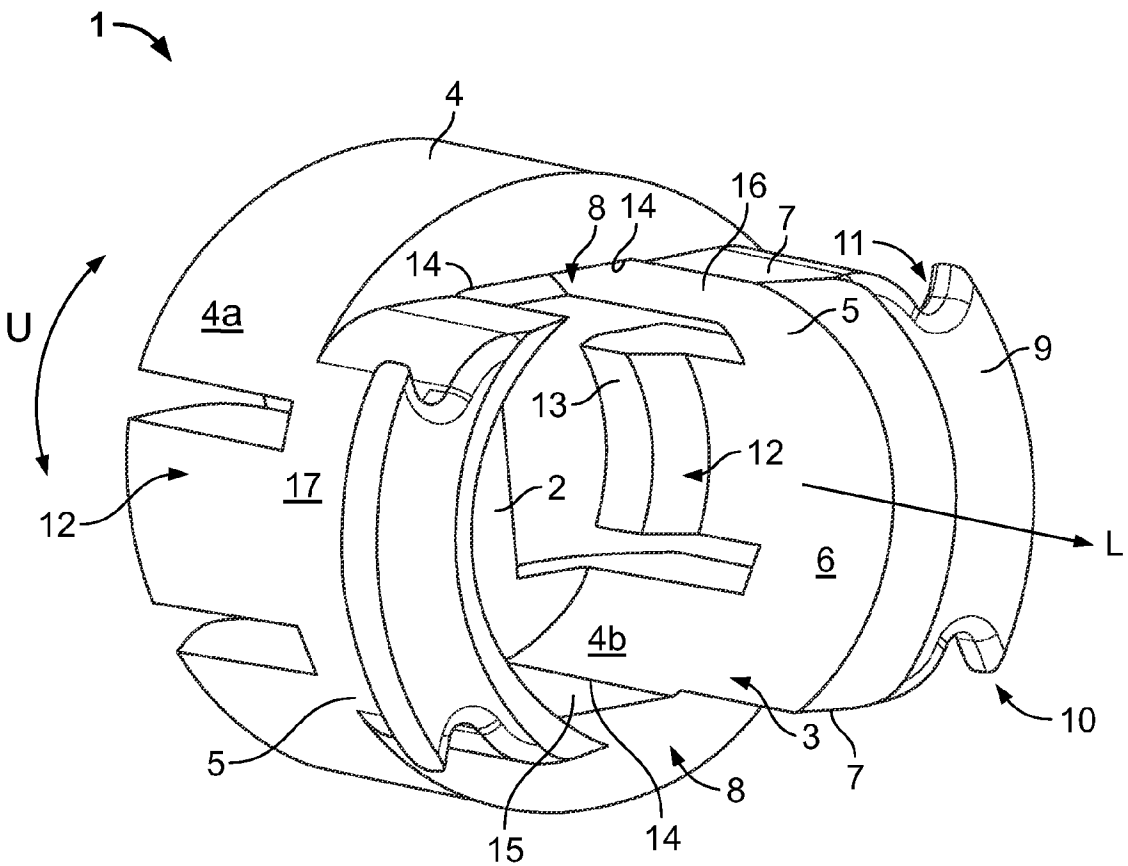
FIG. 1 is a schematic perspective view of an end cap according to the present invention.

First, the design of an end cap 1 according to the invention will be described with reference to FIG. 1. The end cap 1 is essentially pot-shaped and is equipped with a receptacle 3 for a core 21, such as an antenna rod, which is not shown in FIG. 1. The end cap is especially suitable for an antenna rod in which the guide device secures only the end region of the wire winding and directs the wire for the purpose of winding reversal or return to a terminal contact. The end cap is suitable for both winding directions. The receptacle 3 is closed off on one side in the longitudinal direction L by means of a cover portion 2. Near the cover portion 2, the receptacle 3 is bounded by a holding portion 4 that substantially encloses the receptacle 3. The external contour 4*a* of the holding portion 4 may exhibit a shape that is independent of the internal contour 4*b* of the receptacle 3.

At least one jaw 5 extends in the longitudinal direction L along the side of the receptacle facing away from the cover portion 2. The internal surface 6 of the at least one jaw 5 continues the internal contour 4*b* of the receptacle 3 in the longitudinal direction L. In the peripheral direction U, the jaw 5 extends around only one part of the external contour 4a, so at least one aperture 8 adjoins its two edges 7 located in the peripheral direction U. The aperture 8 opens in the longitudinal direction L on the side facing away from the cover portion 2, and terminates at the holding portion 4 of the receptacle 3.

If, as shown in FIG. 1 by way of example, a plurality of jaws 5, for example, two jaws, are disposed in the peripheral direction U, substantially equally spaced apart, then the number of apertures 8 corresponds with the number of jaws 5, so that each aperture 8 is restricted in the peripheral direction U by the edges 7 of two successive jaws 5.

A guide device 9 is disposed on the jaw 5 and may take the form of a projection 10 shaped as a rib or flange attachment that extends in the peripheral direction U and projects outwards in the radial direction. With this embodiment, the option also exists to select the guide device 9 for a turn of the wire 22 that is best suited to the installation situation in positioning terms, without the end cap 1 having to be repositioned on the core 22. Instead of the projection 10 or in addition to the projection 10, a groove or indentation running in the peripheral direction U may be provided on the jaw 5. The projection 10 may extend over the entire jaw 5 in the peripheral direction U or may alternatively simply be pin-shaped (not shown). It may be located on the end of the jaw 5 located in the longitudinal direction L, and may, in particular, terminate substantially flush therewith. If a wire winding is laid behind the projection 10 when viewed from the core 21, the wire 22 can be secured in a simple manner. The projection 10 may alternatively extend in the winding direction W. Further, in order to improve the securing of the wire 22 when a turn is made, the projection 10 may be provided with, on at least one end as shown in FIG. 1, or alternatively on both ends of the projection 10 located in the peripheral direction U, an indentation 11 open in the longitudinal direction L. The clearance width of the indentation 11 is at least large enough to accommodate the diameter of the wire 22.

The receptacle 3 may be provided with a latching means 12, for example, a pair of radially flexible detents 13 located radially opposite one another which are designed to latch with a counter-latching means on the core 21, or which simply serve to hold the end cap 1 on the core 21 by means of friction. Alternatively, the core 21 may also be indented or connected in some other manner to the end cap 1 by form-fit, friction-fit, or material-fit.

The internal contour 4*b* of the receptacle 3 preferably corresponds with the external contour 4*a* of the core 21 to be inserted, and is equipped with at least one longitudinal edge 14 extending in the longitudinal direction L, at which edge 14 the course of the internal contour 4*b* suddenly changes sharply. In the embodiment shown, four longitudinal edges 14 of this kind are provided, each of them separating a flattened, essentially level region 15 from a curved segment 16.

The edge 7 of a jaw 5 is located near a longitudinal edge 14 of this kind, so its outermost end is, at least approximately, flush with the longitudinal edge 14. The wall thickness of the jaw 5 decreases towards the edge 7 in the peripheral direction U, wherein a sharp angle preferably arises between the internal surface 6 and the external surface 17 of the jaw 5. As a result, near the edge 7, the external surface 17 continues along, at least approximately tangentially and optionally without a step, the internal contour 4*b* of the holding portion 4 in the region that overlaps with the aperture 8 in the longitudinal direction L. The edge 7 of the jaw 5 located in the peripheral U and/or winding W direction may herein at least virtually align in the longitudinal direction L with the longitudinal edge 14. If, in this embodiment, the wire 22 is transferred to the core 21 at the point of the jaw edge 7 aligned with the longitudinal edge 14, a smooth transition between jaw 5 and core 21 can be achieved.

The end cap 1 is preferably made from plastic, which may be injection-molded. The end cap may be symmetrical in design, which simplifies modeling if the end cap is made from injection-molded plastic.

Figure 2:
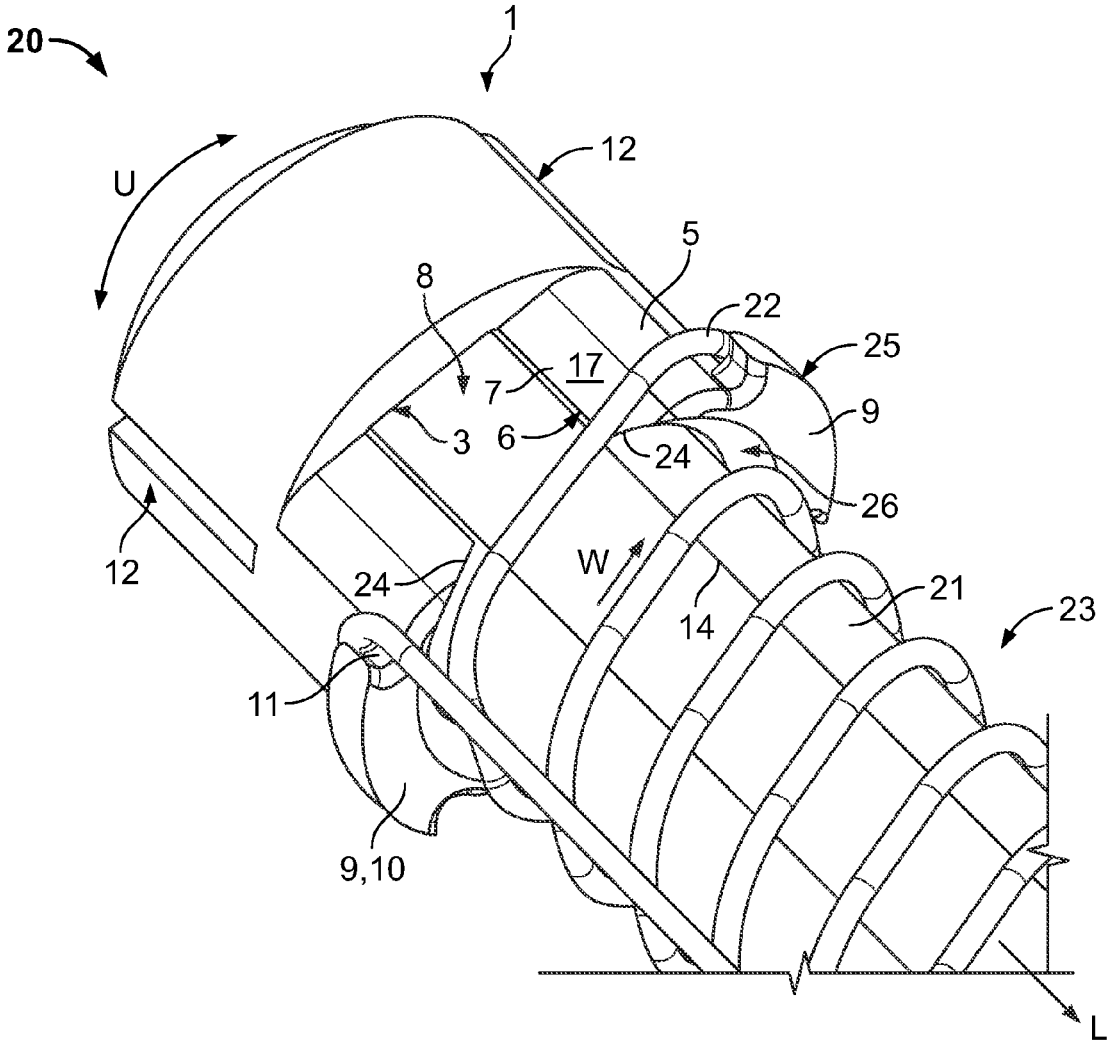
FIG. 2 is a schematic perspective view of the end cap shown in FIG. 1 installed in an antenna module.

FIG. 2 shows the end cap 1, as installed in an inductive component 20 (in this embodiment, an antenna module with a rod antenna). The inductive component 20 further comprises a core 21, which may be rod-shaped and made from a ferromagnetic material such as ferrite, and a wire 22 made from a material with good electrical conduction properties.

One end of the core 21 is inserted into the receptacle 3 and latched with the latching means 12. In the longitudinal direction L, it extends from the end cap 1 to the end remote from the cover portion 2.

The wire 22 is wound around the core 21 to form a coil 23. The winding direction W of the coil 23 exhibits a component in the peripheral direction U and a component in the longitudinal direction L.

Viewed from the core 21, part of the wire 22 runs in the longitudinal direction L behind at least one guide device 9, behind the two guides 9 in FIG. 2, and is turned around the end of a projection 10 in the longitudinal direction L, which end faces in the peripheral direction U and winding direction W. The wire 22 interfaces the jaw 5, for example, with its last winding, while still bearing on the core 21 near the aperture 8. To turn the wire 22, it is guided through the indentation 11, the diameter of which is at least large enough to accommodate the diameter of the wire 22.

The edge 7 of the jaw 5 is designed so that wire 22 meets the jaw 5 smoothly, without lifting away from the core 21 or kinking. This is achieved in that the external surface 17 of the edge 7 continues the external contour of the core 21, at least approximately tangentially, and does not form a step. This is accomplished in part because the edge 7 terminates near the longitudinal edge 14 of the external contour of the core 21, and the wall thickness tapers toward the edge in the peripheral direction U, whereas its internal contour 6 bears on the core 21. This measure also leads to a smoother transition of the wire 22 from the jaw 5 onto the core 21. Due to the reducing wall thickness, a step or discontinuity at the transition between the jaw 5 and the core 21 can be largely avoided. A step or discontinuity of this kind would lead to a separation of the wire 22 from the core 21, and to scatter losses and increased mechanical stress on the wire 22. Also due to the reducing wall thickness, the wire 22 can be guided to lie essentially flat against the core 21. This solution is especially simple to realize if, at least in the region of an edge of the jaw 5, the external contour of the core is equipped with a longitudinal edge at which the contour progression suddenly changes.

In addition, the internal contour of the jaw 5 may initially continue along the internal contour of the receptacle 3, and then widen in the longitudinal direction L so that a winding receptacle is formed. The winding receptacle may be dimensioned such that a wire winding laid around the core 21 can be accommodated therein. In such an embodiment, the wire winding may be guided up to below the jaw 5, leading to shorter overall lengths. To this end, the winding receptacle may, according to another embodiment, lie approximately at the same level as the guide device 9 in the longitudinal direction L. In such an embodiment, it is possible to compensate the tolerance of the core 21.

The apertures 8 allow the wire 22 to contact the core 21 between the jaws 5, so the wire 22 can be received as close as possible to the guide device 9 on the surface of the core 21 without any losses in efficiency.

As can also be seen in FIG. 2, the end of the jaw 5 located in the longitudinal direction L is beveled at least sectionally relative to the plane perpendicular to the longitudinal direction L. This enables the winding of the wire 22 to be received as close as possible to the jaws. To this end, the corners 24 of the jaw 5 are tapered. In addition, the end portion 25 of the jaw 5, which is located in the longitudinal direction L, widens radially. The widening roughly corresponds with a wire 22 diameter, so a winding can be accommodated in the end region 25. At its end facing in the longitudinal direction of the core 21, the jaw 5 may be beveled, at least in the corner 24 region, relative to the plane perpendicular to the longitudinal direction L, wherein the bevel preferably runs in the winding direction W. As a result, the wire windings laid around the part of the core 21 projecting from the receptacle 3 can be guided close to the jaw 5.

The end cap 1 in the above embodiment enables the wire 22 to be wound directly onto the core 21 over the greatest possible winding length. Only a small part of the coil 23 is located on the end cap 1. The end cap 1 can also fulfill additional functions. For example, fastening means may be provided so that the end of the core 21 can be secured. Finally, the assembly of the end cap 1 can take place not only by insertion of the core 21 in the longitudinal direction L, as shown in FIG. 1 and 2, but alternatively by, for example, lateral push-fitting of the end cap 1 essentially transversely relative to the longitudinal direction L. To this end, notwithstanding the embodiment shown, the receptacle 3 may be equipped with at least one radially-opening and flexibly expandable aperture, which is supported against the core 21 at least in decentrally opposing regions. Further, the aperture 8 may extend as far as to the cover portion 2 of the receptacle 3. In this embodiment, the holding portion 4 is formed by the jaws 5.

This solution with its simplicity of design has the advantage that the wire 22 is separated from the core 21 only in the region of the jaw 5, where the wire 22 is secured against displacement by the guide device 9. As soon as the wire 22 winding leaves the jaw 5, the wire 22 can bear directly on the core 21, so the efficiency is only slightly impaired.

In any one of the embodiments described above, the end cap 1 can be used, in particular, for a miniaturized inductive component, such as an antenna module, in particular for printed-circuit board assembly. The wire 22 may be wound around the core 21 and along the core 21 towards the end cap 1, and, when viewed from the core 21, be laid with at least one winding around a jaw 5 behind the guide device 9. The wire 22 is turned at a guide device 9 and then returned. The return preferably takes place at a point on the periphery of the core 21 at which the winding began, at the end of the core 21 that is opposite the end cap 1. The inductivity can be precisely set by means of the quantity of the section of winding that lies around the jaw 5 or jaws 5 of the end cap 1 and the subsequent part of the core 21 in the peripheral U or winding W direction that is not covered. This will be further simplified if two or more guides 9 are provided, around which guides 9 the wire 22 can be turned as required, depending on the necessary fine adjustment of the inductivity.

What is claimed:

1. An end cap for an inductive component, the end cap comprising:

a receptacle configured to receive the inductive component along a longitudinal direction;

a cover portion positioned on and closing one side of the receptacle;

a jaw extending in the longitudinal direction along another side of the receptacle facing away from the cover portion; and a guide device disposed on one side of the jaw opposite the cover portion and configured to allow turning of a wire thereon.

2. The end cap according to claim 1, wherein a wall thickness of the jaw decreases toward an edge of the jaw in a peripheral direction.

3. The end cap according to claim 1, wherein an external surface of the jaw follows an internal contour of the receptacle in a peripheral direction at an edge of the jaw.

4. The end cap according to claim 1, wherein an internal contour of the receptacle forms a longitudinal edge in a peripheral direction.

5. The end cap according to claim 4, wherein an edge of the jaw located in the peripheral direction substantially borders the longitudinal edge.

6. The end cap according to claim 1, wherein an end of the jaw facing in the longitudinal direction is beveled relative to a plane perpendicular to the longitudinal direction.

7. The end cap according to claim 1, wherein an internal surface of an end portion of the jaw widens radially in the longitudinal direction.

8. The end cap according to claim 1, the guide device comprising:

a projection extending radially outward.

9. The end cap according to claim 8, the projection comprising:

an indentation on an end of the projection facing in a peripheral direction, the indentation being open in the longitudinal direction.

10. The end cap according to claim 1, further comprising:

a plurality of the jaws, the jaws being separated by an aperture.

11. The end cap according to claim 10, further comprising:

a plurality of the guide devices, one guide device being associated with each of the jaws.

12. The end cap according to claim 1, wherein the end cap is symmetrical.

13. The end cap according to claim 1, further comprising:

a detent configured to latch with the inductive component.

14. An antenna module, comprising:

a core;

a wire wound around the core; and an end cap configured to receive an end of the core into a receptacle of the end cap along a longitudinal direction, the end cap further comprising a cover portion positioned on and closing one side of the receptacle, a jaw extending in the longitudinal direction along another side of the receptacle facing away from the cover portion, and a guide device positioned on one side of the jaw opposite the cover portion and configured to allow turning of the wire thereon.

15. The antenna module according to claim 14, the core comprising a longitudinal edge.

16. The antenna module according to claim 14, wherein the wire is guided from the core onto the jaw substantially without kinking.

17. The antenna module according to claim 14, wherein the wire contacts the core near an aperture of the end cap and is guided onto the jaw.

18. The antenna module according to claim 14, wherein the wire is turned at the guide device from a winding direction into the longitudinal direction.

19. The antenna module according to claim 14, wherein an external surface of an edge of the jaw follows an external contour of the core in a winding direction.

20. The antenna module according to claim 19, wherein the wire is guided from the core onto the jaw substantially without kinking.

* * * * *